US009272294B2

(12) United States Patent
Ogawa et al.

(10) Patent No.: US 9,272,294 B2
(45) Date of Patent: Mar. 1, 2016

(54) LIQUID EJECTING HEAD AND LIQUID EJECTING APPARATUS

(75) Inventors: Nozomi Ogawa, Matsumoto (JP); Hajime Nakao, Azumino (JP); Isamu Togashi, Matsumoto (JP)

(73) Assignee: Seiko Epson Corporation (JP)

( * ) Notice: Subject to any disclaimer, the term of this patent is extended or adjusted under 35 U.S.C. 154(b) by 301 days.

(21) Appl. No.: 13/433,824

(22) Filed: Mar. 29, 2012

(65) Prior Publication Data

US 2012/0248226 A1 Oct. 4, 2012

(30) Foreign Application Priority Data

Mar. 31, 2011 (JP) ..... 2011-077900

(51) Int. Cl.
*A62C 2/08* (2006.01)
*B05B 1/14* (2006.01)
*B41J 1/00* (2006.01)

(52) U.S. Cl.
CPC ..... *B05B 1/14* (2013.01); *B41J 1/00* (2013.01)

(58) Field of Classification Search
CPC ..... B05B 1/14; B41J 1/00; B41J 2/01
USPC ..... 239/548, 549, 550; 347/65–72, 40, 44, 347/56, 61
See application file for complete search history.

(56) References Cited

U.S. PATENT DOCUMENTS

2002/0041308 A1* 4/2002 Cleland ..... B23P 15/16 347/47
2002/0167569 A1* 11/2002 Hosono ..... B41J 2/14274 347/70
2004/0085411 A1* 5/2004 Takahashi ..... B41J 2/14233 347/68
2008/0174641 A1* 7/2008 Ogawa ..... B41J 2/1612 347/71
2008/0259133 A1* 10/2008 Hara ..... H01L 41/0973 347/70

FOREIGN PATENT DOCUMENTS

| | | | | |
|---|---|---|---|---|
| JP | 08-132628 | | 5/1996 | |
| JP | 2000-177119 | | 6/2000 | |
| JP | 2005-068250 | | 3/2005 | |
| JP | 2005-68250 | A | 3/2005 | |
| JP | 2006-239927 | | 9/2006 | |
| JP | 2006239927 | * | 9/2006 | ..... B31J 2/045 |
| JP | 2008-087371 | A | 4/2008 | |

* cited by examiner

*Primary Examiner* — Len Tran
*Assistant Examiner* — Joel Zhou
(74) *Attorney, Agent, or Firm* — Harness, Dickey & Pierce, P.L.C.

(57) ABSTRACT

The portions at the circumferential edges of a flow channel formation plate in which the corner portions of a dummy flow channel portion are formed are weaker than other portions, and thus when thermal stress has occurred due to temperature changes when the constituent elements of a flow channel unit are affixed to each other, cracks can be induced preferentially in the weak portion, rather than the other portions, starting from the ends of the corner portions. In particular, although similar corner portions are formed in a common liquid chamber, the intersection angle of the corner portions in the dummy flow channel portion is smaller than the intersection angle of the corner portions in the common liquid chamber, and thus it is easier for stress to concentrate in the corner portions of the dummy flow channel portion.

8 Claims, 5 Drawing Sheets

LIQUID EJECTING HEAD AND LIQUID EJECTING APPARATUS

BACKGROUND

1. Technical Field

The present invention relates to a liquid ejecting head having serial liquid flow channels that span from a common liquid chamber formed in a flow channel formation plate to nozzle openings through pressure chambers, and to a liquid ejecting apparatus that includes such a liquid ejecting head.

2. Related Art

An ink jet recording head (called simply a "recording head" hereinafter) used in an image recording apparatus (liquid ejecting apparatus) such as a printer, a coloring material ejecting head used in the manufacture of color filters for liquid-crystal displays and the like, an electrode material ejecting head used to form electrodes for organic EL (electroluminescence) displays, FEDs (field emission displays) and the like, a bioorganic matter ejecting head used in the manufacture of biochips (biochemical devices), and so on can be given as examples of liquid ejecting heads that eject liquid droplets from nozzle openings by causing pressure fluctuations in a liquid within pressure chambers.

In the examples mentioned above, the recording head is configured so as to include a flow channel unit that has: a nozzle plate in which a plurality of nozzle openings are provided; a flow channel formation plate in which channel portions formed of spaces, grooves, and so on are provided so as to define serial ink flow channels that span from a common ink chamber to the nozzle openings through pressure chambers; and an elastic plate (also called a sealing plate, which seals the open surface of the flow channel formation plate) in which regions corresponding to the pressure chambers elastically deform based on operations of pressure generation elements (for example, see JP-A-2000-177119, and FIG. 4, FIG. 10, and so on in that document). Of the constituent elements of the flow channel unit, a high processing finesse and processing accuracy are required for the flow channel formation plate in order to handle increased resolutions in recorded images, increased speeds in recording operations, and so on. Accordingly, a silicon single-crystal substrate (a silicon wafer), in which fine shapes can be formed at a high degree of dimensional precision through anisotropic etching or the like, is favorable for use as the material of the flow channel formation plate. However, a plate member made of a metal such as stainless steel is used as the material of the nozzle plate and the elastic plate, due to the ease of processing such a material.

As described above, flow channel portions such as a through-hole (called simply a "reservoir" hereinafter) that serves as the common ink chamber are provided in the flow channel formation plate through anisotropic etching or the like; according to the recording head disclosed in JP-A-2000-177119, and FIG. 4, FIG. 10, and so on in that document, the end regions in the reservoir are formed in a tapered shape that narrows gradually as the reservoir approaches those ends. Doing so makes it possible to ensure a smooth ink flow at the end regions of the reservoir, and makes it possible to prevent bubbles from accumulating in these regions.

With the constituent elements of the flow channel unit that is configured of the stated nozzle plate, flow channel formation plate, and elastic plate, an adhesive is interposed between those constituent elements, and the constituent elements are affixed to each other by heating and curing the adhesive. However, in the case where the flow channel formation plate is configured of silicon and the nozzle plate is configured of a plate member made of a metal such as stainless steel, there are differences in the coefficients of linear expansion between those constituent elements; thus changes in temperature caused by heating and cooling during the affixing can cause the constituent elements to extend and contract relative to each other, resulting in the constituent elements deforming. At that time, because the edges of the flow channel formation plate are more rigid than the center in which the flow channel portions are provided, stress is concentrated at the border area between the high-rigidity regions and the low-rigidity regions; this can cause cracks to appear in the flow channel formation plate. In particular, in the case where the end regions of the reservoir have a tapered shape as in the example disclosed in JP-A-2000-177119, and FIG. 4, FIG. 10, and so on in that document, due to the taper, stress is concentrated in the tapered portions; as a result, it is easy for cracks to appear from the tapered ends.

If cracks appear in the flow channel portions such as the reservoir in such a manner, ink may leak to the exterior of the recording head through the cracks, or ink that has leaked through a crack may enter into the flow channel portion corresponding to another color of ink and intermix with that ink.

SUMMARY

It is an advantage of some aspects of the invention to provide a liquid ejecting head capable of preventing the appearance of cracks in a liquid flow channel of a flow channel formation plate to the greatest extent possible, and to provide a liquid ejecting apparatus including such a liquid ejecting head.

A liquid ejecting head according to an aspect of the invention includes a nozzle plate in which a nozzle row configured of a plurality of nozzles is formed, and a flow channel formation plate that is formed of a different material from the nozzle plate and in which a plurality of pressure chambers that communicate with the plurality of nozzles are formed; the liquid ejecting head ejects a liquid from the nozzles. The flow channel formation plate has: a common liquid chamber that communicates with the plurality of pressure chambers and that has tapered corner potions formed in both ends; and a dummy flow channel portion that is formed opposing the common liquid chamber and that has formed, in both ends thereof, corner portions whose angles are smaller than the corner portions formed in the common liquid chamber.

According to this configuration, the portions at the circumferential edges of the flow channel formation plate in which the corner portions of the dummy flow channel portion are formed are weaker than the other portion, and thus when thermal stress has occurred due to temperature changes when the constituent elements of the flow channel unit are affixed to each other, cracks can be induced preferentially in the weaker portion, rather than the other portions, starting from the ends of the corner portions. In particular, although similar corner portions are formed in the common liquid chamber, the intersection angle of the corner portions in the dummy flow channel portion is smaller than the intersection angle of the corner portions in the common liquid chamber, and thus it is easier for stress to concentrate in the corner portions of the dummy flow channel portion.

In addition, it is preferable for the corner portions formed in the dummy flow channel portion to be located closer to the circumferential edge of the flow channel formation plate than the corner portions formed in the common liquid chamber.

By forming the corner portions closer to the circumferential edge of the flow channel formation plate in addition to adjusting the intersection angles of the corner portions to be smaller, the stress can be concentrated more easily, and cracks can be induced with certainty.

Furthermore, it is preferable for the flow channel formation plate to be formed of a crystalline base member.

In addition, it is preferable that one of two faces that form the corner portions of the above dummy flow channel portion be a close-packed plane in a crystal structure.

The close-packed plane in a crystal structure breaks more easily than the other planes of other angles. In other words, breaks occur with ease along the close-packed plane when there is a concentration of stress. By setting one face forming the corner portions to the close-packed plane, it is possible to induce cracks in the corner portions with even more certainty.

In addition, it is preferable that the common liquid chamber be formed as a long-hole and the corner portions be formed in both ends thereof, and the dummy flow channel portion be formed as a long-hole and be formed so as to be longer than the common liquid chamber.

Generally speaking, the common liquid chamber is formed as a long-hole and the stated corner portions are formed in both ends thereof, but by also forming the dummy flow channel portion as a long-hole and forming the dummy flow channel portion so as to be longer than the common liquid chamber, the corner portions of the dummy flow channel portion are located further outside than those of the common liquid chamber, which increases the concentration of stress and makes it easy to induce cracking.

Furthermore, it is preferable that a plurality of common liquid chambers be formed, and the dummy flow channel portion be formed in a position that has the common liquid chambers on both sides thereof.

By doing so, cracking is induced preferentially in the single dummy flow channel portion rather than in the common liquid chambers on both sides thereof, and a smaller number of dummy flow channel portions may be sufficient.

Of course, cracking can be induced in the same manner in a liquid ejecting apparatus provided with such a liquid ejecting head.

As a specific example of a liquid ejecting head, a configuration that includes a flow channel unit including the following can be given: a nozzle plate in which a nozzle row configured of a plurality of nozzles is formed; a flow channel formation plate in which a predetermined liquid flow channel is formed for each of nozzle openings and a common liquid chamber is formed, and that is formed of a different material from the nozzle plate and in which a plurality of pressure chambers that communicate with the plurality of nozzles. Here, the flow channel unit forms a serial liquid flow channel spanning from the stated common liquid chamber to the stated nozzle openings through the stated pressure chambers.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a preferred embodiment of the invention will be described with reference to the appended drawings. Although various limitations are made in the embodiment described hereinafter in order to illustrate a specific preferred example of the invention, it should be noted that the scope of the invention is not intended to be limited to this embodiment unless such limitations are explicitly mentioned hereinafter. The following describes an ink jet recording head (called simply a "recording head" hereinafter) installed in an ink jet recording apparatus (a type of liquid ejecting apparatus; called simply a "printer" hereinafter) as an example of a liquid ejecting head according to the invention.

Figure 1:
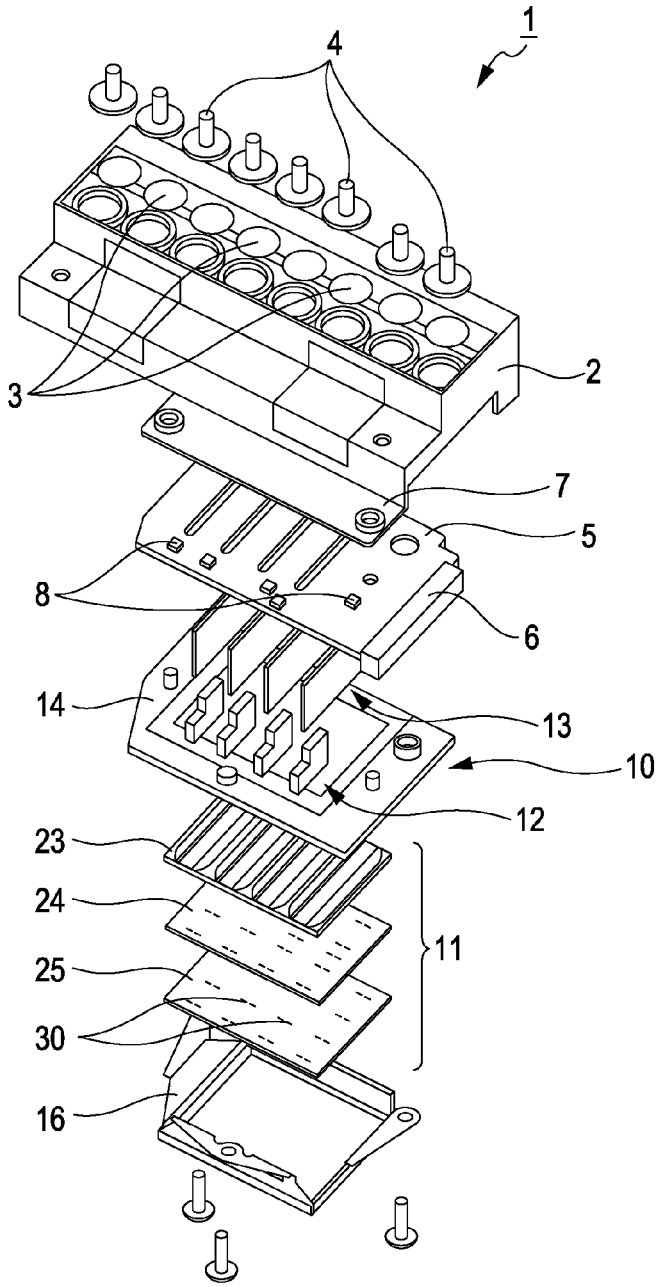
FIG. 1 is an exploded perspective view illustrating an example of the configuration of a recording head.
Figure 2:
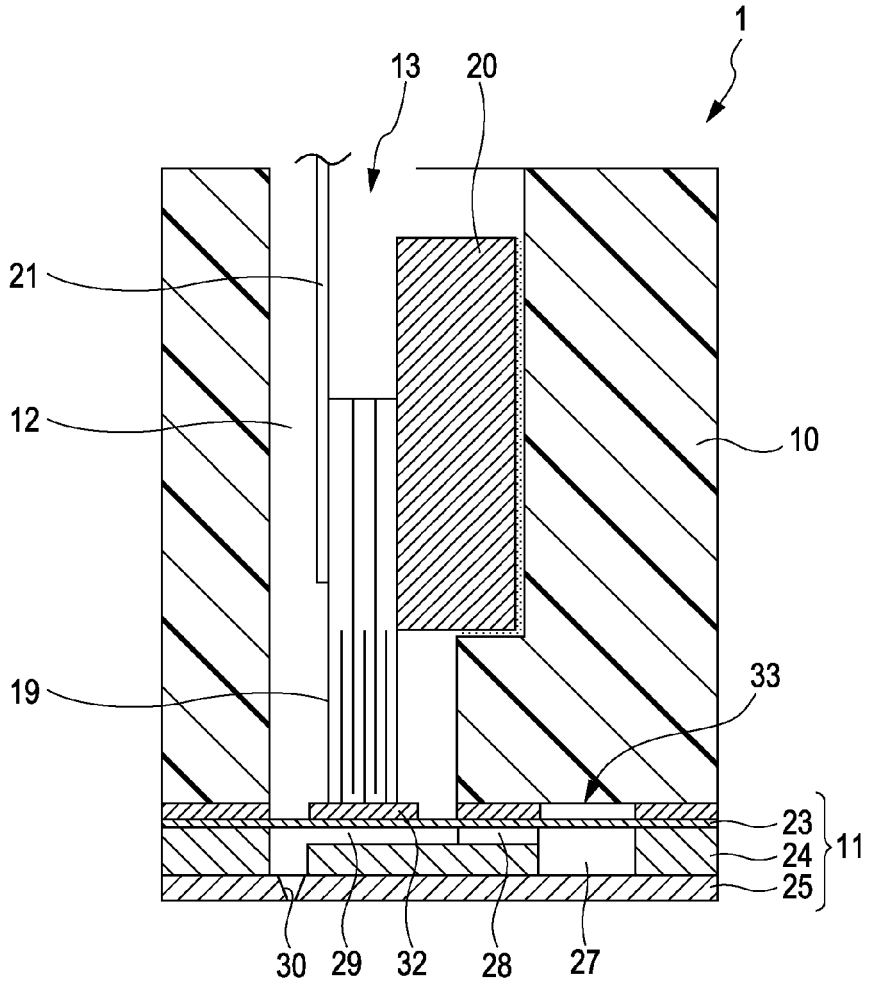
FIG. 2 is a cross-sectional view illustrating the principal constituent elements of a recording head.

FIG. 1 is an exploded perspective view illustrating a recording head 1 according to this embodiment, whereas FIG. 2 is a cross-sectional view illustrating the primary components of the recording head 1. The recording head 1 illustrated as an example here has a cartridge base 2 (called a "base" hereinafter), a driving board 5, a case 10, a flow channel unit 11, and an actuator unit 13 as its primary constituent elements. The base 2 is molded from a synthetic resin such as epoxy resin, and a plurality of ink introduction pins 4 are attached to the top surface thereof with a filter 3 interposed therebetween. Ink cartridges (not shown) that contain ink (a type of liquid) are mounted to these ink introduction pins 4.

A wiring pattern for supplying driving signals from a main printer unit (not shown) to piezoelectric vibrators 19 is formed on the driving board 5, and a connector 6 for connecting to the main printer unit, electronic components 8 such as resistors and capacitors, and so on are mounted to the driving board 5. The connector 6 is connected to a wiring member such as an FFC (flexible flat cable), and the driving board 5 receives driving signals from the main printer unit through this FFC. The driving board 5 is disposed on the bottom surface side of the base 2, which is on the opposite side as the ink introduction pins 4, with a sheet 7 that serves as a gasket being interposed between the driving board 5 and the base 2.

The case 10 is a hollow box-shaped member configured of a synthetic resin, and the flow channel unit 11 is affixed to the leading end surface (the bottom surface) thereof; the actuator unit 13 is housed within a housing cavity 12 formed within the case 10, and the driving board 5 is attached to a board attachment surface 14, which is on the opposite side of the case 10 as the flow channel unit 11. Furthermore, a head cover 16 configured of a thin plate-shaped member made of a metal is attached to the leading end surface of the case 10 so as to enclose the edges of the flow channel unit 11 from the outside thereof. This head cover 16 protects the flow channel unit 11, the case 10, and so on, and also has a function for setting a nozzle plate 25 of the flow channel unit 11 to a ground potential and preventing interference such as noise caused by static electricity produced by recording paper or the like.

The stated actuator unit 13 is configured of a plurality of piezoelectric vibrators 19 (a type of pressure generation element) arranged in a row in a comb-tooth shape, an anchor plate 20 to which the piezoelectric vibrators 19 are affixed, a wiring member 21 such as a TCP (tape carrier package) for transmitting driving signals from the driving board 5 to the piezoelectric vibrators 19, and so on. Each of the piezoelectric vibrators 19 has its anchored end affixed to the surface of the anchor plate 20, whereas the free end thereof protrudes outward further than the leading end surface of the anchor plate 20. In other words, each of the piezoelectric vibrators 19 is attached to the anchor plate 20 in a so-called cantilever state. In addition, the anchor plate 20 that supports the respective piezoelectric vibrators 19 is configured of, for example, stainless steel that is approximately 1 mm thick. The actuator unit 13 is housed and anchored within the housing cavity 12 by affixing the rear surface of the anchor plate 20 to a case inner wall surface that defines the housing cavity 12.

The flow channel unit 11 is configured by affixing flow channel unit constituent elements including an elastic plate 23, a flow channel formation plate 24, and the nozzle plate 25 to each other in a stacked, integrated state using an adhesive, and is a member that forms a serial ink flow channel (this corresponds to a liquid flow channel according to the invention) that spans from a common ink chamber 27 (a common liquid chamber) to nozzle openings 30 through ink supply openings 28 and pressure chambers 29. The pressure chambers 29 are formed as long, narrow chambers that extend in the direction orthogonal to the direction in which the nozzle openings 30 are arranged (called a "nozzle row direction"). Meanwhile, the common ink chamber 27 is a chamber into which ink is introduced from the ink introduction pins 4 that have been inserted into the ink cartridges. The ink introduced into this common ink chamber 27 is supplied and distributed to the pressure chambers 29 through the ink supply openings 28.

The nozzle plate 25 (a type of nozzle formation member according to the invention) disposed on the bottom surface of the flow channel unit 11 is a thin plate-shaped member, made of a metal, in which the plurality of nozzle openings 30 are provided in rows that follow a paper transport direction (a sub scanning direction) at a pitch that corresponds to the dot formation density (for example, 180 dpi). The nozzle plate 25 according to this embodiment is configured of a stainless steel plate member, and a plurality of rows of nozzle openings 30 (nozzle rows) are provided therein in the scanning direction of the recording head 1 (the main scanning direction). A single nozzle row is configured of, for example, 180 nozzle openings 30. The recording head 1 according to this embodiment is configured so as to be capable of ejecting a total of four colors of ink, or cyan (C), magenta (M), yellow (Y), and black (K), and a total of four nozzle rows corresponding to those colors are formed in the nozzle plate 25.

The flow channel formation plate 24, which is one constituent element in the flow channel unit, is a plate-shaped member in which is formed a flow channel portion 40 that serves as an ink flow channel; specifically, an opening portion 41 that serves as the common ink chamber 27, grooves that serve as the ink supply openings 28, and cavities 42 that serve as the pressure chambers 29 (see FIG. 4) are formed and defined therein. In this embodiment, the flow channel formation plate 24 is created by carrying out anisotropic etching on a silicon wafer, which is a crystalline base member. Details of the flow channel formation plate 24 will be given later using FIG. 4.

The elastic plate 23 disposed on the surface of the flow channel formation plate 24 that is on the opposite side as the nozzle plate 25 is a composite plate member having a dual-layer structure in which an elastic film is laminated upon a support plate made of a metal such as stainless steel. Island portions 32 to which the tips of the free ends of the piezoelectric vibrators 19 are affixed are formed in portions of the elastic plate 23 corresponding to the pressure chambers 29, and these portions function as diaphragm portions. In other words, this elastic plate 23 is configured so that the elastic film surrounding the island portions 32 elastically deforms in response to operations of the piezoelectric vibrators 19. Furthermore, the elastic plate 23 seals one of the open surfaces of the opening portion 41 in the flow channel formation plate 24 and thus functions as a compliance portion 33. Only the elastic film is present in the areas that correspond to this compliance portion 33.

Note that the elastic plate 23 can also be called a sealing plate that seals one of the open surfaces of the flow channel portion 40 formed in the flow channel formation plate 24.

In the recording head 1, when driving signals are supplied to the piezoelectric vibrators 19 from the driving board 5 through the wiring member 21, the piezoelectric vibrators 19 expand and contract in the lengthwise direction of the vibrators; as a result, the island portions 32 move toward or away from the corresponding pressure chambers 29. Through this, the volumes of the pressure chambers 29 change, and pressure fluctuations are produced in the ink within the pressure chambers 29 as a result. Ink droplets (a type of liquid droplet) are ejected from the nozzle openings 30 as a result of these pressure fluctuations. In other words, it can be said that the piezoelectric vibrators 19 are one type of pressure generation source that causes the ink within the pressure chambers 29 to be ejected from corresponding nozzle openings 30 as ink droplets by producing pressure fluctuations in the ink within the pressure chambers 29.

Figure 3:
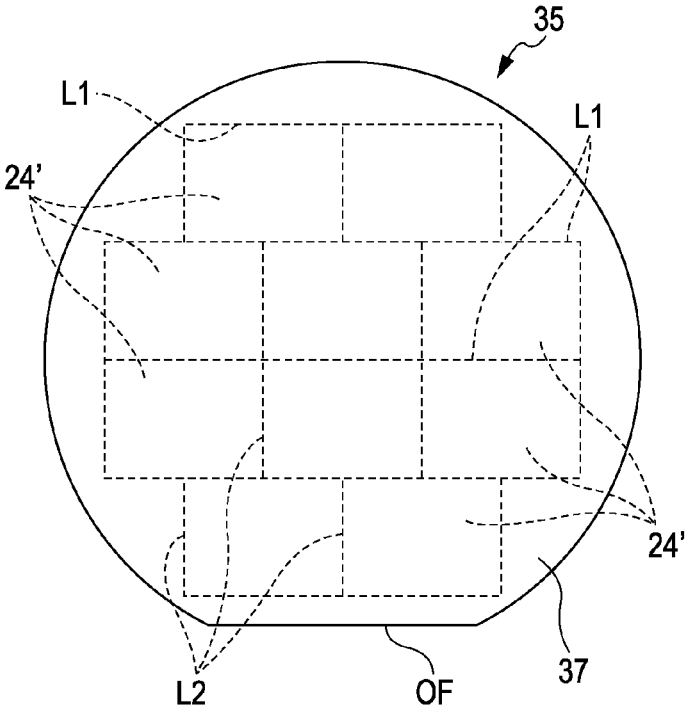
FIG. 3 is a plan view illustrating a silicon wafer that serves as the base member of a flow channel formation plate.

FIG. 3 is a plan view illustrating a silicon wafer 35 that serves as the material of the stated flow channel formation plate 24. The silicon wafer 35 is a silicon single-crystal substrate whose surface 37 is set to a surface corresponding to, for example, a crystal orientation plane (110). A plurality (ten, in this embodiment) of substrate regions 24', which will serve as the flow channel formation plates 24, are defined by cutting guide lines L1 and L2 on the surface 37 of the silicon wafer 35, and the flow channel portions 40 (see FIG. 4) that are to serve as the ink flow channels are formed in the corresponding substrate regions 24' through anisotropic etching. Furthermore, a breakage pattern is formed along the cutting guide lines L1 and L2 by opening a plurality of long, fine through-holes using the anisotropic etching. Note that the horizontal cutting guide lines L1 in FIG. 3 are set along the (110) plane in a planar direction of a first (111) plane that is orthogonal to the (110) plane. Meanwhile, the vertical cutting guide lines L2 that are orthogonal to the horizontal cutting guide lines L1 are set to an axial direction that is vertical relative to the first (111) plane. The stated first (111) plane configures an orientation flat OF (so-called "orifla") that serves as the reference surface for the anisotropic etching.

Figure 4:
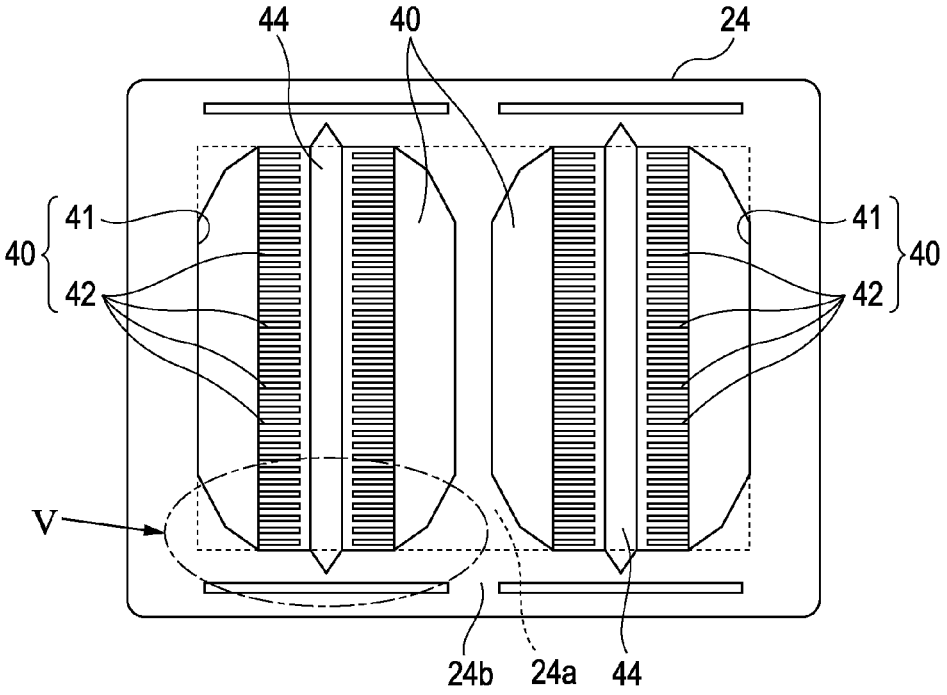
FIG. 4 is a plan view illustrating the configuration of a flow channel formation plate.

FIG. 4 is a plan view illustrating the configuration of a flow channel formation plate 24 obtained by dividing the stated silicon wafer 35 along the cutting guide lines L1 and L2. As shown in FIG. 4, the flow channel portion 40 configured of the opening portion 41, the cavities 42, and so on is formed through anisotropic etching in a central area 24*a* of the flow channel formation plate 24. In this embodiment, a total of four rows of opening portions 41 that serve as the common ink chambers 27 are formed in correspondence with the stated four colors of ink. A plurality of grooves (not shown) that will serve as the ink supply openings 28, and a plurality of cavities 42 that will serve as the pressure chambers 29, are formed so as to branch from the opening portions 41 in correspondence with the nozzle openings 30 provided in the nozzle plate 25. A total of four flow channel portions 40 configured of the opening portions 41, a row of cavities 42, and so on are formed in the flow channel formation plate 24 according to this embodiment along the main scanning direction. In FIG. 4, a set of left-side flow channel portions 40 and a set of right-side flow channel portions 40 form respective pairs, and are disposed so that the rows of cavities 42 (pressure chamber rows) face each other.

Meanwhile, dummy flow channel portions 44, which are through-holes that are not involved in the ejecting of ink droplets, are arranged in the flow channel formation plate 24 so as to form gaps between the flow channel portions 40. In this embodiment, the dummy flow channel portions 44 are provided in a total of two locations, one each between the flow channel portions 40 that make up a pair. More specifically, the dummy flow channel portions 44 are provided between the rows of the cavities 42 in the adjacent flow channel portions 40. These dummy flow channel portions 44 are provided so as to form gaps between the flow channel portions 40 (that is, so as not to communicate with the flow channel portions 40), and are thus portions into which ink normally does not enter; these portions function as buffering holes for adjusting the rigidity of part of the flow channel formation plate 24, or to be more specific, for intentionally reducing the rigidity between rows of the cavities 42 and dissipating the concentration of stress between the rows of the cavities 42 when the piezoelectric vibrators 19 are driven. In addition, these dummy flow channel portions 44 function as spill ports into which excess adhesive or bubbles enter when affixing the constituent elements of the flow channel unit, and prevent the adhesive from flowing into the flow channel portions 40, prevent adhesion problems caused by bubbles entering between the constituent elements, and so on.

Incidentally, both ends of each of the opening portions 41 in the sub scanning direction have a tapered shape that decreases gradually toward those ends. Doing so enables the ink to flow smoothly at both ends of each of the opening portions 41, or in other words, at both ends of the common ink chambers 27, and prevents bubbles from accumulating at those areas. However, stress is concentrated at both ends of each of the opening portions 41 due to the tapered shape, and thus it is easy for cracks to appear from those ends. If cracks appear in the flow channel portions 40, such as in the opening portions 41, there is a risk that ink will leak to the exterior of the head through those cracks, or that ink that has leaked out from the cracks will enter into the flow channel portions 40 corresponding to other colors of ink and intermix therewith. The shape of the dummy flow channel portions 44 in the flow channel formation plate 24 has been conceived in order to solve this problem; by employing this shape, the stated problem is solved. This will be shown hereinafter.

Figure 5:
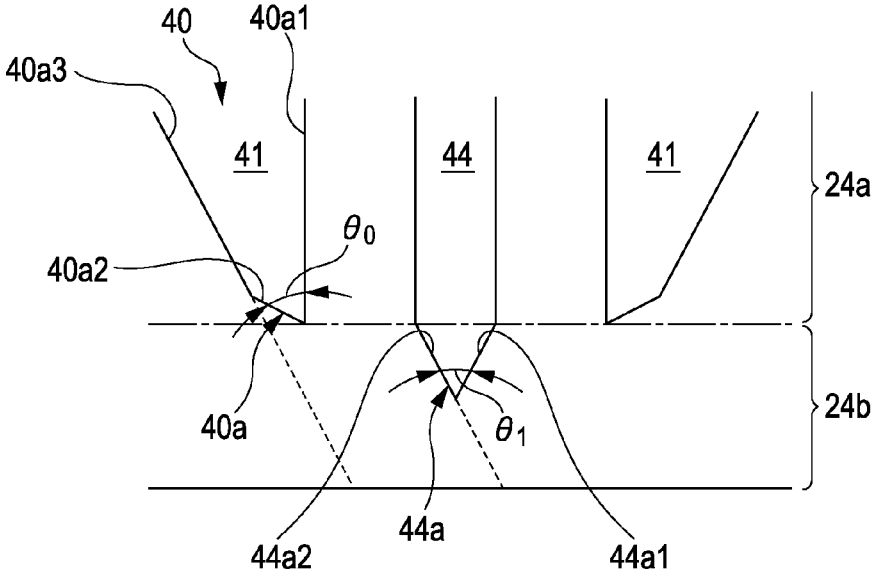
FIG. 5 is an enlarged view of the region V shown in FIG. 4.

FIG. 5 is an enlarged view of the region V shown in FIG. 4. The dummy flow channel portions 44 in the flow channel formation plate 24 have corner portions 44*a*, which narrow toward the outside of the flow channel formation plate 24, in both ends thereof in the direction orthogonal to the direction in which the flow channel portions 40 are arranged (in this embodiment, the sub scanning direction). Likewise, corner portions 40*a* are formed in the ends of each of the flow channel portions 40. Both the corner portions 44*a* and 40*a* are formed so that two surfaces intersect at areas that are close to the circumferential edges of the flow channel formation plate 24. However, the intersection angle ($\theta_1$) of the corner portions 44*a* in the dummy flow channel portions 44 is less than the intersection angle ($\theta_0$) of the corner portions 40*a* in the flow channel portions 40 ($\theta_0>\theta_1$).

To rephrase, making the intersection angles different in this manner makes it is easier for stress to concentrate at the corner portions 44*a*, which has the smaller intersection angle of the corner portions 40*a* and the corner portions 44*a*. Doing so not only reduces the rigidity of the corner portions 44*a* beyond that of the corner portions 40*a* at the circumferential edge area 24*b*, but also makes it easier for stress to concentrate at that location. In other words, it is easier for cracks to appear in the corner portions 44*a* of the dummy flow channel portions 44 than in the corner portions 40*a* on both sides of the flow channel portions 40.

Here, crystalline base members like the silicon wafer 35 that serves as the base member for the flow channel formation plate 24 in this embodiment tend to break easily along the crystal orientation plane in which atoms in the crystals are the densest, or in other words, the close-packed plane, when subjected to an external force, collisions, or the like. The close-packed plane differs depending on the crystal structure of the base member; for example, with the silicon wafer 35 according to this embodiment, the (111) plane serves as the close-packed plane in a face-centered cubic (FCC) structure, whereas the (110) plane serves as the close-packed plane in a body-centered cubic (BCC) structure. In this embodiment, at least one of the two surfaces 44*a*1 and 44*a*2 that define the corner portions 44*a* is set to the close-packed plane P of the flow channel formation plate 24 (the silicon wafer 35). Specifically, one surface 44*a*2 of the corner portions 44*a* is set to a second (111) plane, which intersects at approximately 70° with the first (111) plane serving as the orientation flat on the (110) plane. In other words, the surface 44*a*2 functions as a crack-inducing surface that actively induces cracks to form. By setting at least one of the surfaces defining the corner portions 44*a* to the close-packed plane P (that is, to be a crack-inducing surface) in this manner, it can be made easier for cracks to form along the crack-inducing surface from the end of the corner portions 44*a*.

Meanwhile, although the close-packed plane P is assigned to a surface 40*a*3 at the end of the flow channel portions 40, a surface 40*a*2 that has yet another angle is provided so that a gradual curve is formed at the end of the flow channel portions 40. In other words, the intersection angle between this surface 40*a*2 and another surface 40*a*1 is greater than the intersection angle between the two surfaces 44*a*1 and 44*a*2 that form the corner portions 44*a* of the dummy flow channel portions 44, and thus cracks can be induced both because it is easy for stress to concentrate at the corner portions 44*a* and due to the crystal structure.

Meanwhile, the dummy flow channel portions 44 and flow channel portions 40 are basically formed as long-hole shapes that follow the stated sub scanning direction, and the dummy flow channel portions 44 are longer than the flow channel portions 40. Accordingly, the corner portions 44*a* of the dummy flow channel portions 44 are located closer to the circumferential edge portions of the flow channel formation plate 24 than the corner portions 40*a* of the flow channel portions 40. It can be said that such a positional relationship between the two makes it easier for stress to concentrate at the corner portions 44*a*. Furthermore, because a single dummy flow channel portion 44 has a flow channel portion 40 on either side thereof, cracks form in the dummy flow channel portion 44 before forming in the flow channel portions 40, and thus it is possible to reduce the number of dummy flow channel portions 44. Because the overall rigidity will drop when cracking is induced, a higher overall rigidity can be maintained with a smaller number of dummy flow channel portions.

Figure 6:
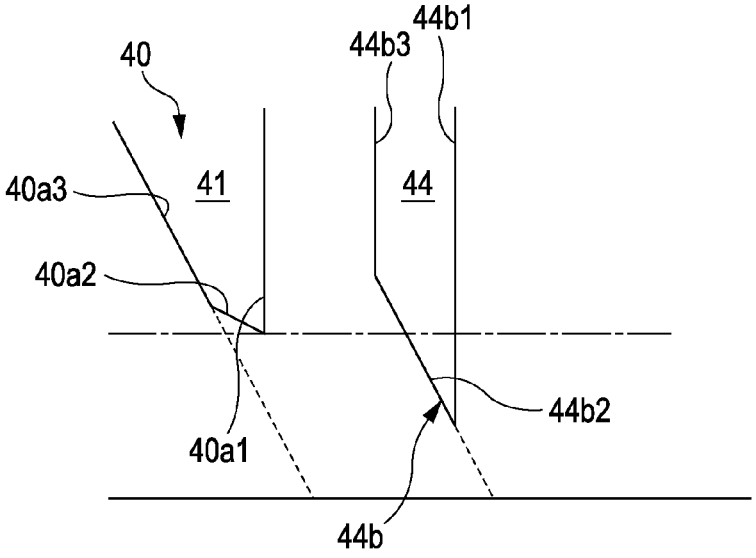
FIG. 6 is a diagram illustrating a variation on a corner portion of a dummy flow channel portion.

FIG. 6 illustrates a variation on the dummy flow channel portions 44.

In this example, corner portions 44*b* at the ends of the dummy flow channel portions 44 are formed so that one surface 44*b*1 that follows the lengthwise direction of the dummy flow channel portions 44 and a surface 44*b*2 that is defined by close-packed plane P intersect. With the dummy flow channel portions 44, another surface 44*b*3 that is parallel to the stated surface 44*b*1 is arranged in the lengthwise direction, and the corner portions 44*b* are formed at the ends of the dummy flow channel portions 44 by the surface 44*b*2 that intersects with the two parallel surfaces 44*b*1 and 44*b*3. Because it is necessary, in the flow channel portions 40, to form a gently-curved surface by causing a surface 40*a*1 that is parallel to the surfaces 44*b*1 and 44*b*3 to intersect with another surface 40*a*2 that corresponds to the surface 44*b*2, the intersection angle of the corner portions 44*b* can be set to an angle that is smaller than the intersection angle of the corner portions 40*a*.

Figure 7:
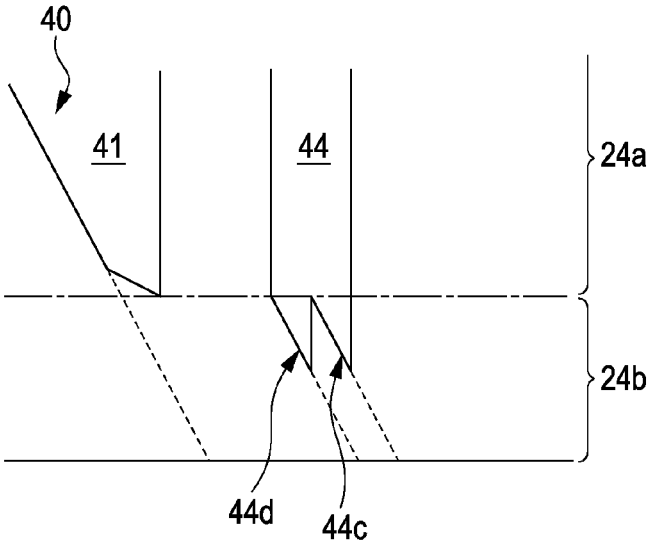
FIG. 7 is a diagram illustrating a variation on a corner portion of a dummy flow channel portion.

FIG. 7 illustrates a variation on the dummy flow channel portions 44.

In this example, two corner portions 44*c* and 44*d* are formed at the ends of the dummy flow channel portions 44. The surfaces of which the respective corner portions 44*c* and 44*d* are formed are the same as the two surfaces 44*b*1 and 44*b*2 illustrated in FIG. 6. The intersection angles in the respective corner portions 44*c* and 44*d* are smaller than the intersection angles in the corner portions of the flow channel portions 40, and furthermore, because there are two corner portions, it is even easier to induce cracks in the dummy flow channel portions 44.

Figure 8:
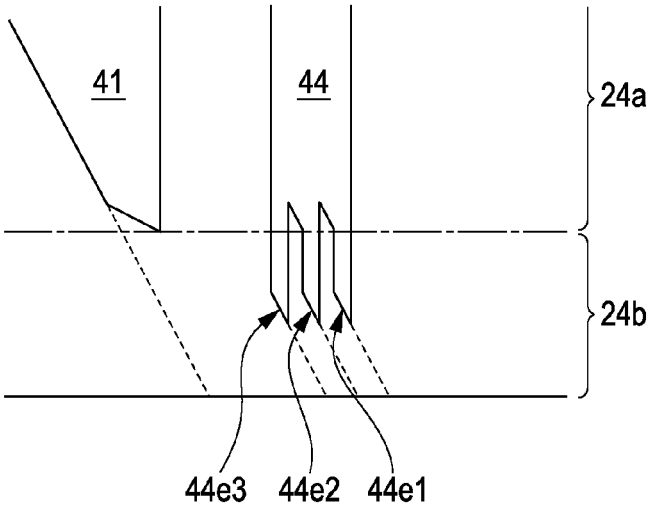
FIG. 8 is a diagram illustrating a variation on a corner portion of a dummy flow channel portion.

FIG. 8 illustrates a variation on the dummy flow channel portions 44.

In this example, three fine groove-shaped portions are formed in the ends of the dummy flow channel portions 44. Corner portions 44*e*1, 44*e*2, and 44*e*3 are formed at the ends of the respective groove-shaped portions. The intersection angles formed by the two surfaces in the corner portions 44*e*1, 44*e*2, and 44*e*3 are smaller than the intersection angles of the flow channel portions 40 for the same reason as the aforementioned examples; it is thus easier for stress to concentrate in the groove-shaped portions, which makes it easier to induce cracking.

As described thus far, the dummy flow channel portions 44 in the flow channel formation plate 24 have, in the ends in the direction orthogonal to the direction in which the dummy flow channel portions 44 and flow channel portions 40 are arranged, the corner portions 44*a* and 44*b* that narrow toward the outside of the flow channel formation plate 24, and these corner portions 44*a* and 44*b* are formed so that the intersection angle at the ends thereof is smaller than the intersection angle of the corner portions 40*a* in the flow channel portions 40; accordingly, at the circumferential edge area 24*b*, it is easier for stress to concentrate in the corner portions 44*a* and 44*b* of the dummy flow channel portions 44 than in the corner portions 40*a* of the flow channel portions 40 and the corner portions 44*a* and 44*b* of the dummy flow channel portions 44 are weaker, and therefore when thermal stress has occurred due to temperature changes occurring when affixing the constituent elements of the flow channel unit together, cracks can be induced preferentially in the weaker portions starting from the corner portions 44*a* and 44*b* than in the other portions. Accordingly, thermal stress occurring during the affixing can be dispersed, which makes it possible to suppress cracks from appearing in the flow channel portions 40 to the greatest extent possible. As a result, it is possible to prevent in advance problems such as ink leaking to the exterior from the recording head 1, ink leaking from a flow channel portion 40, entering into another flow channel portion 40, and intermixing with the ink therein, and so on.

Incidentally, the invention is not limited to the above-described embodiment, and many variations based on the content of the appended aspects are possible.

Although the above describes an example in which the flow channel formation plate 24 is configured using the silicon wafer 35, the base member of the flow channel formation plate 24 is not limited to the silicon wafer 35, and another crystalline base member can be used instead.

In addition, although the above embodiment describes an example in which the flow channel formation plate 24 is configured of a single plate member, the flow channel formation plate 24 may be configured of a plurality of plate members. In other words, it is also possible to configure the flow channel formation plate 24 of a first flow channel formation plate in which the grooves serving as the ink supply openings 28, the cavities 42 serving as the pressure chambers 29, and so on are formed, and a second flow channel formation plate in which the opening portions 41 that serve as the common ink chambers 27 are formed. In this case, the dummy flow channel portions 44 are formed in the respective plates, and the intersection angles of the corner portions in the dummy flow channel portions 44 are formed so as to be smaller than the intersection angles of the corner portions in the flow channel portions 40.

Furthermore, although the above describes the ink jet recording head 1 as an example of a liquid ejecting head, the invention can also be applied in another liquid ejecting head. For example, the invention can also be applied in a coloring material ejecting head used in the manufacture of color filters for liquid-crystal displays and the like, an electrode material ejecting head used to form electrodes for organic EL (electroluminescence) displays, FEDs (field emission displays), and so on, a bioorganic matter ejecting head used in the manufacture of biochips (biochemical devices), and the like.

It goes without saying that the invention is not intended to be limited to the aforementioned embodiments. The following applications should be apparent to one skilled in the art:

- changing, as appropriate, the combinations of elements, configurations, and so on disclosed in the aforementioned embodiments that are interchangeable with each other; and
- replacing, as appropriate, elements, configurations, and so on in the aforementioned embodiments with elements, configurations, and so on that are not explicitly disclosed in the aforementioned embodiments but are publicly known, or changing combinations thereof.

Although not disclosed in the aforementioned embodiments, replacing elements, configurations, and so on disclosed in the aforementioned embodiments with elements, configurations, and so that can be substitutable based on publicly-known techniques, or changing combinations thereof by a person skilled in the art, is also to be understood as same as being disclosed as an embodiment of the invention.

The entire disclosure of Japanese Patent Application No. 2011-077900, filed Mar. 31, 2011 is expressly incorporated by reference herein.

What is claimed is:

1. A liquid ejecting head comprising: a flow channel formation plate including a common liquid chamber that communicates with a plurality of pressure chambers, and including a dummy flow channel portion that is formed opposing the common liquid chamber, wherein the common liquid chamber includes a first acutely angled corner portion that is defined by a first surface that follows a lengthwise direction of the common liquid chamber and a second surface that intersects a close-packed plane of a crystal structure of the flow channel formation plate, the first acutely angled corner portion extending toward an edge of the flow channel formation plate; the dummy flow channel portion includes a second acutely angled corner portion that is defined by the close-packed plane of the crystal structure and a third surface that intersects the close-packed plane, the second acutely angled corner portion extending toward the edge of the flow channel formation plate; and the second acutely angled corner includes an acute angle that is smaller than an acute angle of the first acutely angled corner portion.

2. The liquid ejecting head according to claim 1, wherein the second acutely angled corner portion is located closer to a circumferential edge of the flow channel formation plate than the first acutely angled corner portion.

3. The liquid ejecting head according to claim 1, wherein the flow channel formation plate is formed of a crystalline base member.

4. The liquid ejecting head according to claim 1, wherein the common liquid chamber is formed as a long-hole and the first acutely angled corner portion is formed in both ends thereof, and the dummy flow channel portion is formed as a long-hole that is formed to be longer than the common liquid chamber.

5. The liquid ejecting head according to claim 4, wherein a plurality of common liquid chambers are formed, and the dummy flow channel portion is formed in a position that has the common liquid chambers on both sides thereof.

6. A liquid ejecting apparatus that ejects a liquid from a plurality of nozzles, the apparatus comprising: a nozzle plate in which a nozzle row configured of a plurality of nozzles is formed; and a flow channel formation plate including a common liquid chamber that communicates with a plurality of pressure chambers, and including a dummy flow channel portion that is formed opposing the common liquid chamber, wherein the common liquid chamber includes a first acutely angled corner portion that is defined by a first surface that follows a lengthwise direction of the common liquid chamber and a second surface that intersects a close-packed plane of a crystal structure of the flow channel formation plate, the first acutely angled corner portion extending toward an edge of the flow channel formation plate; the dummy flow channel portion includes a second acutely angled corner portion that is defined by the close-packed plane of the crystal structure and a third surface that intersects the close-packed plane, the second acutely angled corner portion extending toward the edge of the flow channel formation plate; and the second acutely angled corner portion includes an acute angle that is smaller than an acute angle of the first acutely angled corner portion.

7. The liquid ejecting head according to claim 1, wherein the third surface follows a lengthwise direction of the common liquid chamber.

8. The liquid ejecting head according to claim 7, wherein the dummy flow channel portion includes a plurality of second acutely angled corner portions.

* * * * *